US006791440B2

(12) United States Patent
Harmon et al.

(10) Patent No.: US 6,791,440 B2
(45) Date of Patent: Sep. 14, 2004

(54) APPARATUS FOR ELECTRICALLY ISOLATING CIRCUIT BREAKER ROTOR COMPONENTS

(75) Inventors: Jason Edward Harmon, Bristol, CT (US); Gary Steven Douville, West Hartford, CT (US); Chanchal Kumar Garg, Hyderabad (IN); Linda Yvonne Jacobs, Barkhamsted, CT (US); Thomas Frederick Papallo, Jr., Farmington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/064,655

(22) Filed: Aug. 2, 2002

(65) Prior Publication Data

US 2004/0021536 A1 Feb. 5, 2004

(51) Int. Cl.[7] ..... H01H 83/00

(52) U.S. Cl. ..... 335/16; 218/22; 218/149; 218/156; 335/202

(58) Field of Search ..... 335/16, 147, 132, 335/202, 165–195; 218/22, 149–156; 200/293–308

(56) References Cited

U.S. PATENT DOCUMENTS

| | | | | |
|---|---|---|---|---|
| 4,649,247 | A | * | 3/1987 | Preuss et al. ..... 200/244 |
| 5,313,180 | A | * | 5/1994 | Vial et al. ..... 335/16 |
| 5,351,024 | A | * | 9/1994 | Juds et al. ..... 335/16 |
| 6,281,458 | B1 | | 8/2001 | Castonguay et al. |
| 6,281,461 | B1 | | 8/2001 | Doughty |
| 6,326,868 | B1 | | 12/2001 | Kranz et al. |

* cited by examiner

*Primary Examiner*—Lincoln Donovan
(74) *Attorney, Agent, or Firm*—Karl A. Vick, Esq.; Armstrong Teasdale LLP

(57) ABSTRACT

An electrically isolating iso bearing for a circuit breaker is provided that comprises an inner surface, an outer surface, and a body extending therebetween, said inner surface comprising a pair of bosses and a pair of openings, said outer surface comprising at least one boss, said body comprising a pair of rotor protective flaps.

7 Claims, 3 Drawing Sheets

APPARATUS FOR ELECTRICALLY ISOLATING CIRCUIT BREAKER ROTOR COMPONENTS

BACKGROUND OF INVENTION

This invention relates generally to circuit breakers, and more particularly to circuit breakers for use with rotary contact assemblies.

Circuit breakers are used to interrupt a flow of current when current exceeds a specified value. Such a condition is sometimes referred to as a short circuit condition or an overcurrent value. In a short circuit condition, the circuit breaker robustly separates a pair of contacts that, under normal operating conditions, conduct the current. Separating the contacts electrically isolates the circuit wiring and associated circuit components from potentially damaging currents. At least some known circuit breakers are thermally or magnetically actuated.

In at least some circuit breakers, when the contacts are separated, an electrical arc may be undesirably generated between the contacts. In addition, within at least some circuit breakers, during a short circuit interruption, a dielectric breakdown may occur between the components. Continued operation of the circuit breaker with components that have dielectrically deteriorated, may be detrimental to the performance of the circuit breaker, may contribute to a poor transfer of the arc within an arc chamber, and over time, may limit the ability of the circuit breaker to isolate the components in a robust and timely manner.

To facilitate extending a useful life of the circuit breaker, at least some known circuit breakers use rotary contact assemblies, including iso bearings. The iso bearings facilitate shielding mounting springs on the face of the rotor and facilitate a smooth rotation of the rotor during circuit breaker mechanism operations. However, because of a relative position of the iso bearings with respect to the circuit breaker, the iso bearings do not facilitate protecting conductive rotor parts positioned along a perimeter of the rotor.

SUMMARY OF INVENTION

In one aspect an iso bearing for a circuit breaker is provided that comprises an inner surface, an outer surface, and a body extending therebetween, the inner surface comprising a pair of bosses and a pair of openings, the outer surface comprising at least one boss, and the body comprising a pair of rotor protective flaps.

In one aspect a rotary contact assembly is provided that comprises a rotor assembly comprising a plurality of pins, a linkage assembly, and a pair of rotor halves, each rotor half comprising an inner and an outer surface and a perimeter, the outer surface comprising a plurality of bosses. A contact arm configured to be mechanically and electrically coupled to the rotor assembly inner surface by the plurality of pins and the linkage assembly. A plurality of iso bearings mechanically coupled to the rotor assembly outer surface by the plurality of rotor bosses, the iso bearing comprising a pair of rotor protective flaps partially circumscribing rotary contact assembly perimeter to facilitate shielding the plurality of pins and the link assembly.

In one aspect a circuit breaker is provided that comprises a pair of electrically insulative cassette half pieces comprising a cavity therein, a plurality of electrically conductive straps positioned within the half piece, and a rotary contact assembly positioned in the cavity. The rotor contact assembly is positioned in the cavity and comprises a plurality of pins, a linkage assembly, and a pair of rotor halves, each rotor half comprises an inner and an outer surface and a perimeter, the outer surface comprising a plurality of bosses. A contact arm is configured to be mechanically and electrically coupled to the rotor assembly inner surface by the plurality of pins and the linkage assembly. A plurality of iso bearings mechanically coupled to the rotor contact assembly outer surface by the plurality of rotor bosses, each iso bearing comprises a pair of rotor protective flaps partially circumscribing the rotary contact assembly perimeter to facilitate shielding the plurality of pins and the link assembly. An operating mechanism is configured to separate the conductive straps and the contact arm, and a plurality of arc chambers are coupled to the half pieces.

DETAILED DESCRIPTION

Figure 1:
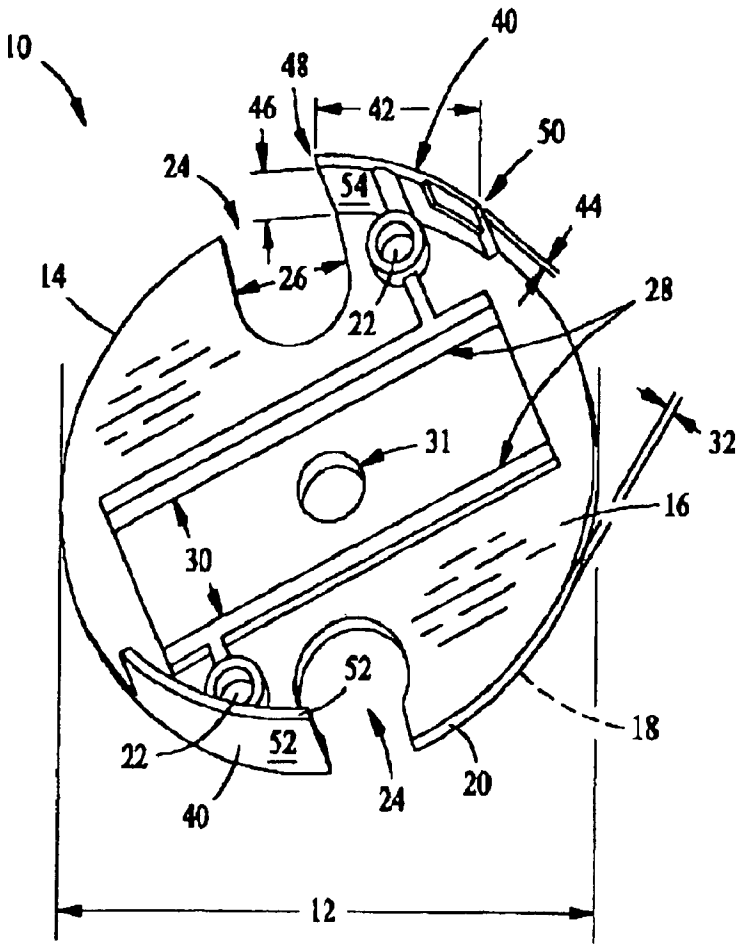
FIG. 1 is perspective view of an electrically isolating iso bearing.

FIG. 1 is perspective view of an electrically isolating iso bearing 10 that may be coupled to an electrical circuit (not shown in FIG. 1). Iso bearing 10 has a diameter 12 and a perimeter 14 that are variably selected based on the circuit requiring protection and an associated circuit breaker. In one embodiment, iso bearing diameter 12 is approximately thirty-three mm. In one embodiment, iso bearing 10 is fabricated from a nonconductive material. In another embodiment, iso bearing 10 is molded from Zytel® 103HSL nylon which is commercially available from DuPont, Wilmington, Del. In an alternative embodiment, iso bearing 10 is molded from polycarbonate or polyester.

Iso bearing 10 includes a body 20 having an inner surface 16, and an oppositely-disposed outer surface 18. Body 20 is circumscribed by perimeter 14. In the exemplary embodiment, body 20 is substantially circular. Inner surface 16 and outer surface 18 are substantially planar. Inner surface 16 includes a pair of diametrically disposed bosses 22 that are each sized to receive a rotor pin (not shown in FIG. 1) therein. More specifically, bosses 22 extend outwardly from inner surface 16. Bosses 22 are substantially circular and are adjacent perimeter 14. Inner surface 16 also includes a pair of diametrically disposed semi-circular openings 24 that are each sized to receive a rotor boss (not shown in FIG. 1) therethrough. More specifically, each opening 24 has a diameter 26 and extends between outer surface 18 and inner surface 16. Openings 24 are defined by a portion of perimeter 14.

A pair of alignment channels 28 extend substantially diametrically across inner surface 16. More specifically, channels 28 are both positioned between each set of bosses 22 and openings 24, and are configured to couple iso bearing 10 to a rotor halve (not shown in FIG. 1). In the exemplary embodiment, channels 28 are substantially parallel and are spaced a distance 30 apart. An inner surface cavity 31 of a bearing boss (not shown in FIG. 1) is positioned between each channel 28 and concentrically with respect to rotor contact assembly center axis (not shown in FIG. 1).

Iso bearing body 20 has a thickness 32 measured between inner surface 16 and bearing outer surface 18. A pair of diametrically opposed rotor protective flaps 40 extend substantially perpendicularly outwardly from inner surface 16 along bearing perimeter 14. Specifically, each rotor protective flap 40 is adjacent each boss 22 and opening 24. Each rotor protective flap 40 has a length 42, a thickness 44, and a height 46. Length 42 is measured between a first end 48 that is adjacent opening 24 and a second end 50 that is circumferentially spaced from end 48. Width 44 is measured between a first sidewall 52 and a second sidewall 54. Flaps 40 are positioned such that first sidewall 52 is substantially aligned with respect to body perimeter 14. Flap height 46 is measured between inner surface 16 and an outer surface 18, and is substantially greater than body thickness 32. Flap 40 dimensions 42, 44, and 46 are variably selected based on the size of a rotary contact assembly (not shown in FIG. 1). Rotor protective flap length 42 and height 46 facilitate flaps 40 shielding the rotor components (not shown in FIG. 1) from electrical engagement with circuit breaker components (not shown in FIG. 1).

Figure 2:
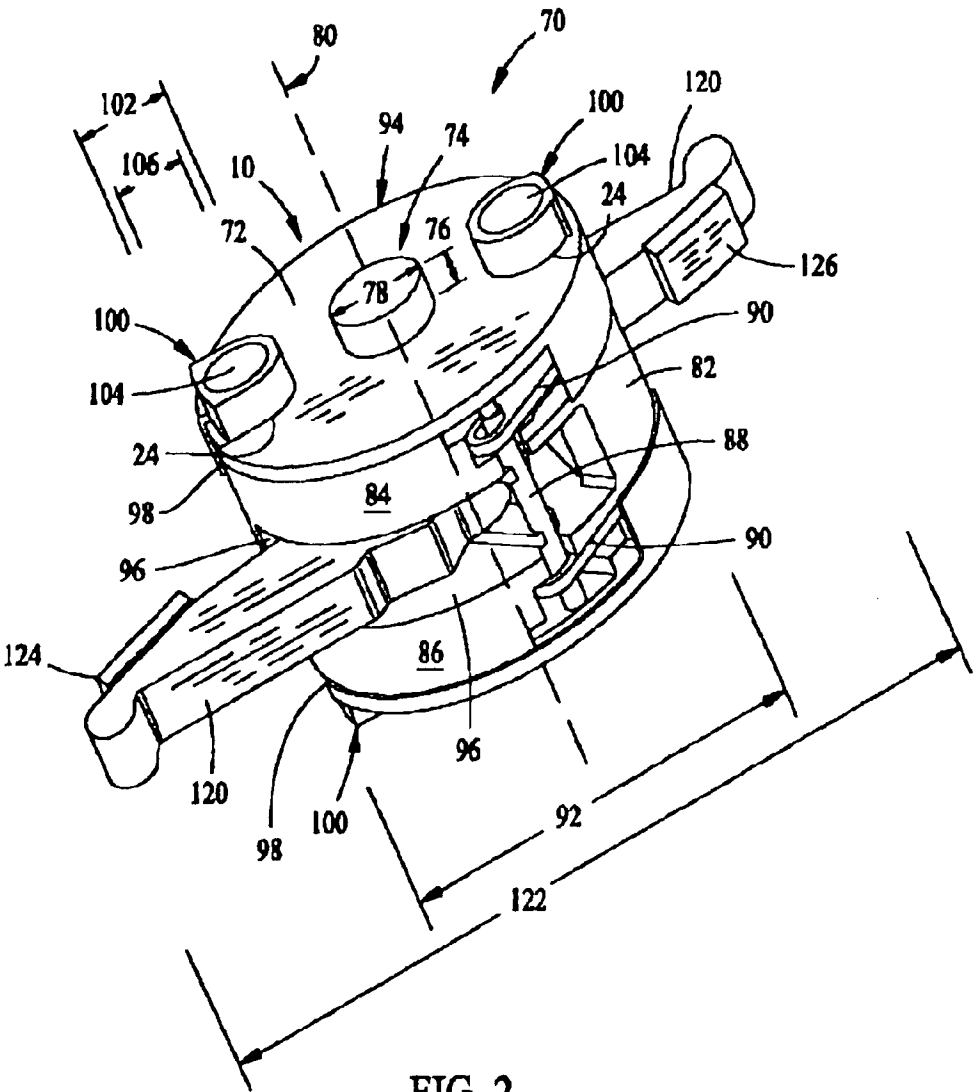
FIG. 2 is perspective view of a rotary contact assembly used with the iso bearing shown in FIG. 1.

FIG. 2 is perspective view of a rotary contact assembly 70 including iso bearing 10. Bearing outer surface 18 includes a bearing boss 74 that extends from outer surface 18 a distance 76. Bearing boss 74 has a diameter 78 and is positioned concentrically with respect to a center axis 80 of rotary contact assembly 70. Boss diameter 78 is smaller than bearing diameter 12 (shown in FIG. 1), such that bearing boss 74 facilitates aligning rotary contact assembly 70 with a cassette half piece (not shown in FIG. 2).

Rotary contact assembly 70 includes a rotor 82 that is substantially circular and includes a first half 84 and a second half 86 connected together by a plurality of pins 88 and a linkage assembly 90 that extends therebetween. In one embodiment, rotor 82 has a diameter 92 and a perimeter 94 that are substantially equal to iso bearing diameter 12 and perimeter 14, respectively. Rotor halves 84 and 86, each have an inner surface 96 and an outer surface 98. Each rotor half 84 and 86, include a pair of rotor bosses 100 having a diameter 102 sized to couple with bearing openings 24. A plurality of openings 104 are disposed within rotor bosses 86. Boss openings 104 have a diameter 106 sized to receive a fastener (not shown) for attaching rotor 82 to cassette half piece (not shown in FIG. 2). Boss opening diameter 106 is smaller than rotor boss diameter 102.

Rotor pins 88 and linkage assembly 90 are mechanically coupled with iso bearing 10, rotor 82 and a rotary contact arm 120. Contact arm 120 extends between the rotor halves inner surfaces 96 and 98 and has a length 122 that is substantially longer than rotor diameter 92. In one embodiment, contact arm 120 is a one-piece assembly. Contact arm 120 includes a first moveable contact 124 and a second moveable contact 126 attached to each end oppositely.

Iso bearing 10 is positioned on rotor 82 such that rotor protective flap 40 arcuately extends perpendicularly towards rotor 82 and covers pins 88 and linkage assembly 90. Flaps 40 facilitate preventing electrical arcing between conductive straps (not shown in FIG. 2) and pins 88 and linkage assembly 90 of rotor 82.

Figure 3:
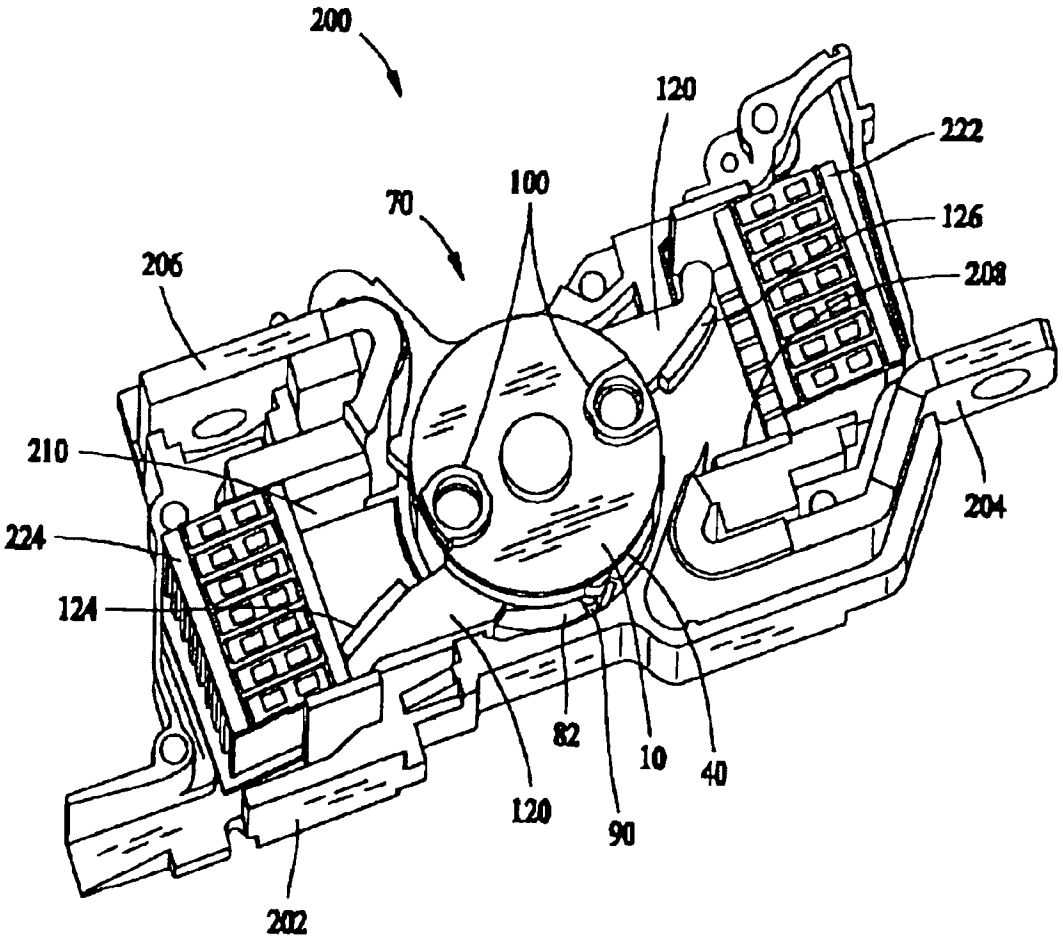
FIG. 3 is a perspective view of a circuit breaker used with the iso bearing shown in FIG. 1.

FIG. 3 is a perspective view of a circuit breaker 200 including iso bearing 10 and rotary contact assembly 70. More specifically, rotary contact assembly 70 is coupled within an electrically isolative cassette half piece 202, and iso bearing 10 is coupled to rotary contact assembly 70. Half piece 202 is attached to a similar cassette half piece (not shown) to form a cassette (not shown). An opposing line-side contact strap 204 and a load-side contact strap 206 are adapted for communication with an associated electrical distribution system (not shown) and a protected electrical circuit (not shown), respectively. Line-side 204 and load-side 206 straps each include a first fixed contact 208 and a second fixed contact 210, respectively. Rotary contact assembly 70 is positioned intermediate line-side contact strap 204 and load-side contact 206 and associated arc chambers 222 and 224, respectively.

Moveable contacts 124 and 126 are coupled to opposite ends of rotary contact arm 120 for making moveable connection with fixed contacts 208 and 210 to permit electrical current flow from line-side contact strap 204 to load-side contact strip 206. Rotor 82 is coupled with the circuit breaker operating mechanism (not shown) by means of rotor pins 88 and rotor linkage assembly 90. Contact arm 120 moves simultaneously with rotor 82 which, in turn, moves moveable contacts 124 and 126 between a CLOSED position (not shown) and a OPEN position as depicted. During a short circuit or an overcurrent condition, perspective contact pairs 124 and 210, and 126 and 208 are separated. When perspective contact pairs 124 and 210, and 126 and 208 are separated, electrical arcing occurs between perspective contact pairs 124 and 210, and 124 and 208. These arcs are cooled and quenched within arc chambers 222 and 224 and not permitted to occur between the contact pairs 124, 210 and 126, 208 and rotor pins 88 and linkage assembly 90 due to the iso bearing rotor protective flaps 40, thus facilitating the prevention of damage to rotary contact assembly 70 and circuit breaker 200.

Iso bearing rotor protective flap 40 facilitates protecting conductive rotor parts along rotor perimeter 92. This helps facilitate the useful life and robust operation of circuit breaker 200.

While the invention has been described in terms of various specific embodiments, those skilled in the art will recognize that the invention can be practiced with modification within the spirit and scope of the claims.

What is claimed is:

1. A circuit breaker comprising:

a pair of electrically insulative cassette half pieces comprising a cavity therein;

a plurality of electrically conductive straps positioned within each said half piece;

a rotor contact assembly positioned in said cavity, said assembly comprising a plurality of pins, a linkage assembly, and a pair of rotor halves, each said rotor half comprising an inner and an outer surface and a perimeter, said outer surface comprising a plurality of bosses;

a contact arm configured to be mechanically and electrically coupled to said rotor assembly inner surface by said plurality of pins and said linkage assembly;

a plurality of iso bearings mechanically coupled to said rotor contact assembly outer surface by the plurality of rotor bosses, each said iso bearing comprising an inner surface, an outer surface, and a body extending therebetween, said inner surface comprising a pair of bosses and a pair of openings, said outer surface comprising at least one boss, said body comprising a pair of rotor protective flaps;

an operating mechanism configured to separate said conductive straps and a contact arm; and a plurality of arc chambers coupled to each said half pieces.

2. A circuit breaker in accordance with claim 1 wherein said pair of rotor protective flaps are diametrically opposed, said flaps extend substantially perpendicularly from said rotary contact assembly perimeter.

3. A circuit breaker in accordance with claim 1 wherein said rotor includes a first half and a second half, said contact arm positioned between said first and second rotor halves.

4. A circuit breaker in accordance with claim 1 wherein said rotor further includes a plurality bosses positioned on each of said first and second halves such that said iso bearings mechanically couple to said rotor.

5. A circuit breaker in accordance with claim 1 wherein each of said iso bearing is fabricated from a nonconductive material.

6. A circuit breaker in accordance with claim 1 wherein said pair of rotor protective flaps are diametrically opposed, said flaps extend substantially perpendicularly from said rotary contact assembly perimeter.

7. A circuit breaker in accordance with claim 1 wherein said iso bearings and said contact arm are configured to rotate about the same axis of rotation.

* * * * *